US005653553A

United States Patent [19]

Gunter

[11] Patent Number: 5,653,553

[45] Date of Patent: Aug. 5, 1997

[54] DRAINAGE CHANNEL AND ASSOCIATED METHOD

[75] Inventor: Charles E. Gunter, Statesville, N.C.

[73] Assignee: ABT, Inc., Troutman, N.C.

[21] Appl. No.: 568,205

[22] Filed: Dec. 6, 1995

[51] Int. Cl.[6] ..... E02B 13/00; E02B 5/00

[52] U.S. Cl. ..... 405/36; 273/DIG. 13; 404/4; 405/119; 472/92

[58] Field of Search ..... 405/119, 118, 405/120; 404/2, 4; 472/92; 273/DIG. 13

[56] References Cited

U.S. PATENT DOCUMENTS

| | | | |
|---|---|---|---|
| Re. 26,366 | 4/1968 | Flegel . | |
| Re. 33,439 | 11/1990 | Thomann et al. . | |
| 502,474 | 8/1893 | Sterling | 405/119 |
| 1,030,839 | 6/1912 | Brereton | 405/119 |
| 3,433,137 | 3/1969 | Henderson . | |
| 3,625,011 | 12/1971 | Stevenson . | |
| 4,312,504 | 1/1982 | Rutledge et al. . | |
| 4,472,078 | 9/1984 | Karbstein . | |
| 4,515,498 | 5/1985 | Thomann et al. . | |
| 4,553,874 | 11/1985 | Thomann et al. . | |
| 4,560,302 | 12/1985 | Karbstein . | |
| 4,621,939 | 11/1986 | Thomann et al. . | |
| 4,630,962 | 12/1986 | Thomann et al. . | |
| 4,630,966 | 12/1986 | Karbstein . | |
| 4,640,643 | 2/1987 | Williams . | |
| 4,699,544 | 10/1987 | Karbstein . | |
| 4,751,945 | 6/1988 | Williams . | |
| 4,787,773 | 11/1988 | Kehler . | |
| 4,838,727 | 6/1989 | Capuano . | |
| 4,913,596 | 4/1990 | Lambert, III . | |
| 4,940,359 | 7/1990 | Van Duyn et al. . | |
| 5,026,202 | 6/1991 | Thomann | 405/118 X |
| 5,106,231 | 4/1992 | Thomann . | |
| 5,110,235 | 5/1992 | Thomann et al. . | |
| 5,120,157 | 6/1992 | Todd, Sr. et al. . | |
| 5,135,331 | 8/1992 | Steiner . | |
| 5,213,438 | 5/1993 | Bärenwald . | |
| 5,226,748 | 7/1993 | Bärenwald et al. . | |
| 5,501,547 | 3/1996 | Mantelli | 405/119 X |

FOREIGN PATENT DOCUMENTS

| | | |
|---|---|---|
| 0056238 | 7/1982 | European Pat. Off. . |
| 0109065 | 5/1984 | European Pat. Off. . |
| 5-132909 | 5/1993 | Japan . |

OTHER PUBLICATIONS

Polydrain®Special Products pamphlet by ABT®, Inc.

Aco Sport®Running Track Drainage & Bordering pamphlet by ACO Polymer Products, Inc., Lit. No. 1–1–89 Copyright 1989.

Polydrain®The Simple Solution To Surface Drainage Sloped System Manual by ABT®, Inc., Copright 1992.

*Primary Examiner*—Dennis L. Taylor

*Attorney, Agent, or Firm*—Bell, Seltzer, Park & Gibson, P.A.

[57] ABSTRACT

An elongate drainage channel capable of receiving runoff from an athletic surface is provided which includes a bottom wall and a pair of sidewalls extending upwardly from the opposed sides of the bottom wall. The drainage channel also includes a projection extending transversely outwardly from the exterior of at least one of the sidewalls and spaced at a predetermined distance below the open top for defining a height to which a subsurface layer is applied adjacent to the drainage channel. The projection is also fracturable from the sidewall so as to act as a mechanical fuse to prevent vibratory or tamping machinery from damaging the drainage channel. In another embodiment of the invention, an elongate channel section is provided which has a bottom surface which includes end portions which are shaped as generally planar reference surfaces. The shaped reference surfaces are generally coplanar with each other and are spaced at a predetermined distance below the open top of the channel for supporting the opposed ends of the channel section in a properly aligned position. The present invention also includes a mold for making drainage channel sections having aligned reference surfaces and associated methods for molding the drainage channel sections and for installing the drainage channel.

28 Claims, 6 Drawing Sheets

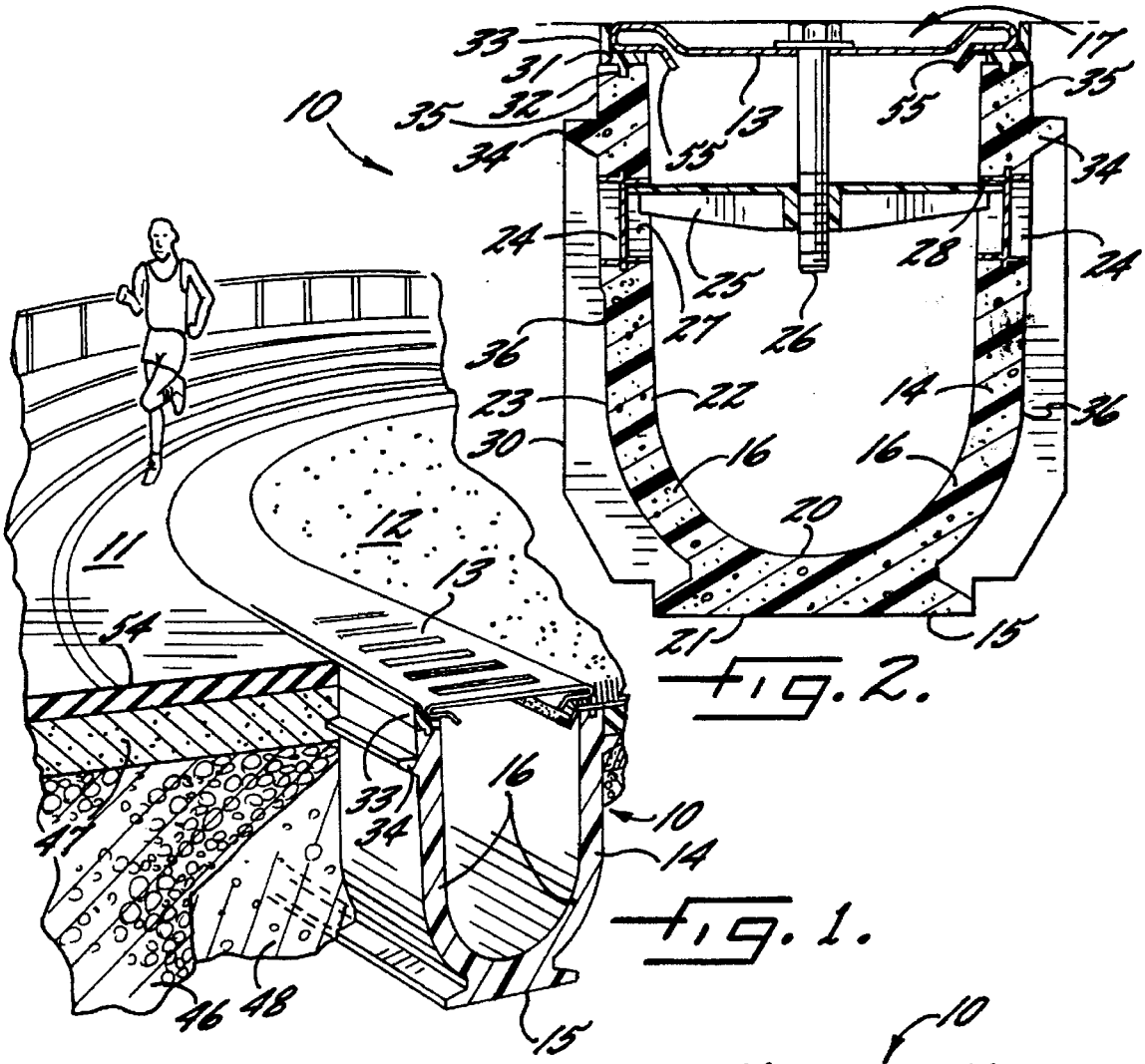
Fig. 2.
Fig. 1.
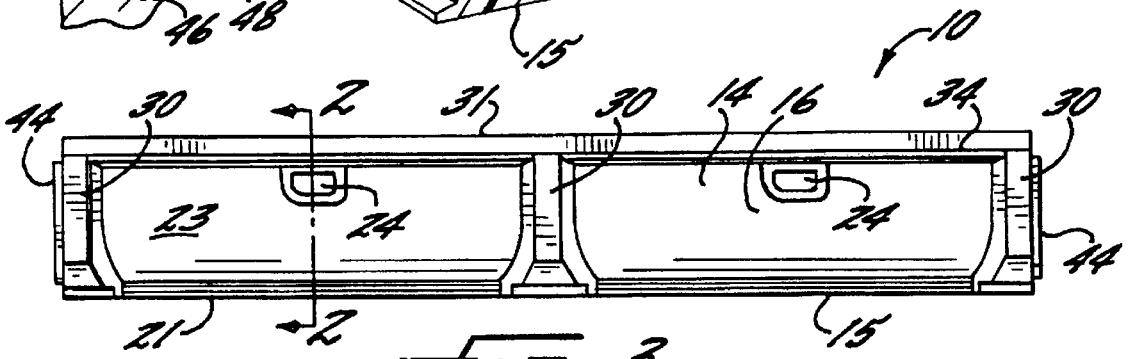
Fig. 3.
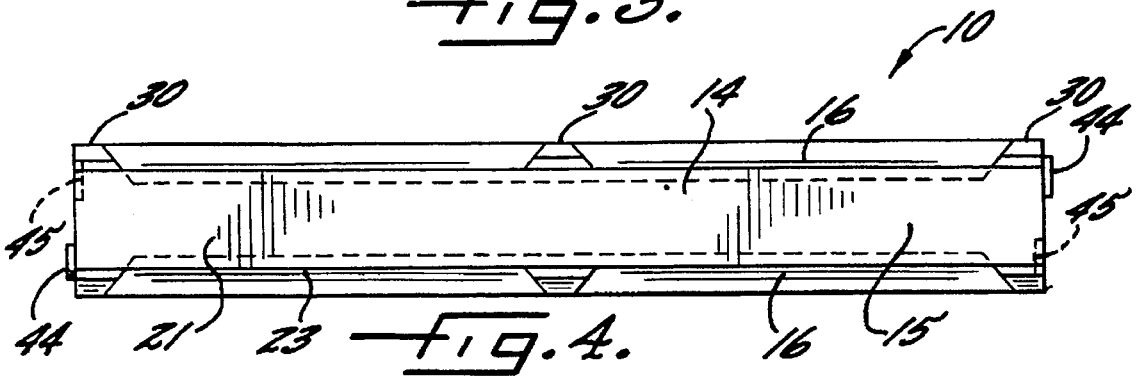
Fig. 4.

DRAINAGE CHANNEL AND ASSOCIATED METHOD

FIELD OF THE INVENTION

The present invention relates to drainage channels, and more particularly relates to drainage channels and associated methods for use with athletic playing surfaces.

BACKGROUND OF THE INVENTION

Athletic playing fields such as football and soccer fields or running tracks are typically provided with a drainage channel system formed alongside the playing surface for receiving and collecting liquid runoff. In particular, running track surfaces may include a polymeric surface which is substantially impervious, making adequate drainage very important. Artificial and natural turf playing surfaces are generally more porous than a running track and may include other drainage systems thereunder, but a drainage channel along the edge of the playing surface may nevertheless be important for draining excess runoff.

For outdoor athletic facilities, a drainage channel system is mainly used for draining rainwater. However, a drainage channel system may also be important in indoor or covered athletic facilities for draining other liquids such as water or solvents used to clean the athletic surface. In either instance, the particular athletic surface may be slightly crowned or sloped from the center to the edges to ensure proper drainage thereof.

A drainage channel system typically includes an elongate and substantially continuous drainage channel extending around the periphery of the athletic surface. The drainage channel may be positioned along the border between athletic surfaces of different types. For example, the drainage channel may be located between a polymeric running track and an artificial turf or natural grass playing field. In addition, the drainage channel may be slightly sloped to enhance flow within the channel. Further, one or more catch basins may be positioned along the channel to collect solid debris and to pass the liquid to effluent pipes for removal from the playing field.

An elongate grate is typically provided over the drainage channel. The elongate grate covers the open top of the channel in order to prevent people from unwittingly stepping into the open channel and/or to prevent relatively large objects from entering the channel and partially blocking the flow of liquid therethrough.

The drainage channel is typically formed from a series of discrete drainage channel sections. A first step in installing such a drainage channel is placing the drainage channel sections in an end-to-end relationship at the proper depth below the desired level of the athletic playing surface. In this regard, a trench may be formed to the desired depth adjacent to the playing surface for receiving the channel sections. Alternatively, the entire area below the athletic playing surface may be graded to the desired depth and various subsurface layers can then be placed thereon, as discussed below.

The adjacent ends of two adjoining drainage channel sections may have interlocking end surfaces and may be supported on a single support brick which has been aligned and secured before placement of the drainage channel sections. It is important that the channel sections be supported in such a manner that the channel sections are precisely aligned so as to ensure proper drainage, to permit the grate to seat properly over the open top of the drainage channel and to prevent adjoining channel sections from being misaligned so as to create a potential trip hazard for athletes or others who pass thereby. This proper alignment of the drainage channel sections can be thwarted even if the support bricks are properly aligned, however, if the drainage channel sections and, more particularly, the respective lower surfaces of the drainage channel sections which are seated upon the support bricks are not properly formed in a predetermined aligned relationship. Once the adjoining drainage channel sections have been interlocked, however, the adjacent ends of the sections may be sealed with an adhesive or sealant to prevent leakage.

Once the drainage channel sections are interlocked in an end-to-end relationship, the lower portions of the drainage channel sections are typically encased in concrete so as to secure the channel. Depending on the type of the desired athletic playing surface, various other subsurface and surface layers are formed over the encasement concrete and the surrounding areas to build up the surface to the desired elevation. For example, after the encasement concrete has been poured, a rock or gravel subsurface layer may be formed thereon.

One or more of these subsurface layers may need to be compressed, such as by tamping, in order to reduce subsequent settling. If improperly applied, it has been found that the compression forces could damage the draining channel. For example, vibratory tamping or rolling machinery could fracture or otherwise damage the sidewalls or bottom wall of the drainage channel, thereby weakening the drainage channel or causing it to leak or collapse.

Upon the compressed gravel layer, an asphalt layer is typically formed. For running track surfaces, a relatively thick asphalt layer is applied so as to allow the uppermost surface of the relatively thin polymeric running track surface which is formed thereover to be at the desired horizontal elevation. For artificial turf surfaces, the underlying asphalt layer may be thinner and may be covered with a layer of cushioning foam such that the overlying artificial turf surface is at the desired level. Alternatively, for artificial turf surfaces, the asphalt and foam layers may be replaced by a resilient elastic layer, also known as an "E-layer", which is formed of discrete rubber particles held together in a binder.

Since the surface layers, such as the artificial turf surface or the running track surface, typically have a predetermined thickness, it is important that the subsurface layers are applied to the proper elevation relative to the drainage channel so that the uppermost exposed surface of the playing surface is located at the desired elevation. This accurate positioning of the playing surfaces is particularly important adjacent a drainage channel or another playing surface since any vertical misalignment between the playing surfaces or the drain channel may create a trip hazard for athletes or others and may create impediment for wheeled vehicles passing thereover.

Prior attempts at providing a suitable drainage channel include a drainage system commercially available under the trademark Aco Sport® from Aco Polymer Products, Inc. to border natural grass surfaces, artificial turf surfaces and/or running track surfaces. The Aco Sport® system includes a number of drainage channel configurations which, in some embodiments, are covered by a variety of grates and/or a polymer concrete hard cover. A number of the Aco Sport® drainage systems include a border or curb formed of ethylene-propylene diene monomer ("EPDM") which delineates the boundary between the adjacent athletic surfaces. Due to the upwardly extending EPDM border, athletes or others must step over the EPDM border to pass over the EPDM border and between the adjacent athletic surfaces. In addition, athletic surfaces which border the Aco Sport® drainage system are also typically at different elevations so as to create an additional barrier to passing between the athletic playing surfaces.

U.S. Pat. No. 3,433,137 to Henderson also describes a drainage system for securing edge portions of an artificial turf playing surface and for providing drainage for the artificial turf surface. The drainage system includes a U-shaped member having a number of interiorly projecting finger-like elements which retain corresponding straps attached to the inner edge of the artificial turf playing surface. The U-shaped member, which may be formed of sheet steel, includes flanged edge portions which may be covered by a layer of resilient material to provide a semi-firm shoulder which is flush with the surface of the adjacent soil.

U.S. Pat. No. 4,553,874 to Thomann, et al. describes another type of drainage system. In particular, Thomann, et al. discloses a slotted grate intended to fit within a preformed cast drainage channel section. The channel section includes a drainage channel body and a cast frame supported thereon for supporting the channel grate. The channel body may be manufactured of polymer concrete and is provided with protrusions on each side to firmly anchor the drainage channel body within a concrete foundation, which encases most of the channel body. Guide tabs on the cast frame intermesh with a pavement layer which may be formed over the concrete.

As described above, several drainage systems, including the Aco Sport® drainage system, have been developed which border athletic playing surfaces in order to receive runoff therefrom. However, these drainage systems still do not fully address the needs of modern athletic playing surfaces. For example, at least some of these prior drainage systems do not maintain the athletic playing surfaces which are adjacent to the opposed sides of the drainage channel in a level orientation in order permit athletes and others to more readily pass thereover. In addition, the prior drainage systems do not include means for insuring that the subsurface layers are formed to the proper elevation or means for preventing unnecessary damage to the drainage channel sections during compaction of the subsurface layers.

SUMMARY OF THE INVENTION

These and other needs are met by the drainage channel of the present invention which, in one embodiment, includes a longitudinally elongate projection extending from a sidewall of the channel. As described below, this elongate projection serves as a mechanical fuse to protect the drainage channel during compaction or compression of the subsurface layers. In addition, the projection provides an installation guide such that the subsurface layers can be formed to the proper elevation, thereby more precisely aligning the resulting surface layers with each other and with the drainage channel.

The elongate drainage channel of the present invention includes a bottom wall and a pair of sidewalls extending upwardly from the opposed sides of the bottom wall so as to define an open top for receiving the runoff from an athletic surface. At least one of the sidewalls advantageously includes a longitudinally elongate projection which extends transversely outwardly from the exterior surface of the sidewall.

The longitudinal projection preferably extends along at least a medial portion of the sidewall and, more preferably, along a substantial longitudinal portion of the sidewall. The projection is also spaced at a predetermined distance below the open top. In particular, the projection extends outwardly beyond at least a section of the sidewall above the projection and beyond at least a section of the sidewall below the projection. At least portions of the sidewall section above and below the projection are generally coplanar with each other. Typically, the projection is nearer to the top of the drainage channel than the bottom so that the section below the projection is larger than the section above the projection. For example, in one advantageous embodiment, the projection is spaced less than about one inch, e.g., between about ¼ inch and one inch, below the open top. In one preferred embodiment, the projection is spaced about ⅝ inch below the open top and corresponds to the thickness of a subsurface foam layer used for supporting artificial turf.

Accordingly, the projection preferably defines the level to which an underlying subsurface layer should be formed. In addition, the channel and projection are preferably formed of a molded cementitious material and the projection can have a thickness less than the thickness of the sidewall such that the projection can fracture or break away from the exterior surface of the sidewall in response to a downward loading force thereon prior to damaging the channel. Thus, the projection can serve as a mechanical fuse which shears away from the drainage channel, prior to incurring damage to the drainage channel, if excessive compaction forces are applied too close to the drainage channel.

The drainage channel is advantageously formed of a series of drainage channel sections arranged end-to-end and each having first and second opposed end surfaces defined by the bottom wall and the sidewalls. The opposed end surfaces include a male projection on the first end surface adjacent one of the sidewalls, a corresponding female recess on the second end surface adjacent that sidewall, a female recess on the first end surface adjacent the other of the sidewalls, and a corresponding male projection on the second end surface adjacent the other sidewall. The channel sections can thus be readily arranged with an interlocking male/female structure since either end of the adjoining channel sections can fit or mate with either end of the other channel section.

The elongate drainage channel typically forms part of an athletic field which also includes a generally horizontal base surface and a subsurface layer deposited on the base surface against the sidewall up to a height defined by the projection. An athletic surface layer overlies the subsurface layer and directs runoff over the sidewall and into the open top of the channel.

In another aspect of the present invention, an elongate channel section includes an exterior bottom surface having opposed end portions adjacent to the opposed ends of the channel section. Each of the end portions of the bottom surface are advantageously shaped, such as by molding or casting, to create generally planar reference surfaces. The shaped reference surfaces are coplanar with each other and are spaced at a predetermined distance below the open top for supporting the opposed ends of the channel section. The shaped reference surfaces thus ensure that the adjacent ends of two adjoining channel sections are properly vertically aligned on a common support, such as a brick.

A method of installing a channel capable of receiving runoff from an athletic surface also forms an aspect of the present invention. The method includes the step of positioning a channel body defined by at least one sidewall having a projection extending therefrom at a predetermined location which will define at least one edge of an athletic surface. A subsurface layer is then formed adjacent the channel body to a height defined by the projection. The subsurface layer may be compressed by applying a downward force thereto. As described above, the projection also serves as a mechanical fuse to protect the channel during compaction operations. A surface layer is then applied over the compressed subsurface layer to a desired elevation, preferably in alignment with an adjacent playing surface and/or with the drainage channel.

Another aspect of the present invention includes a mold for making a drainage channel section. According to this aspect of the invention, the mold preferably includes a plurality of interior molding surfaces shaped for forming an interior surface of the bottom wall, interior and exterior surfaces of the sidewalls, and exterior surfaces of the ends. The mold also includes a pair of interior molding surfaces positioned adjacent the ends of the mold and defining an open portion therebetween. The interior molding surfaces adjacent the opposed ends each define an interior planar surface for forming shaped exterior reference surfaces adjacent the ends of the bottom wall of the channel. These reference surfaces allow adjacent channels to be properly aligned upon a common support during installation such that the resulting drainage channel includes a number of properly aligned drainage channel sections.

An associated method of making a molded elongate drainage channel body includes the steps of forming a mold having the interior molding surfaces discussed above and pouring moldable liquid cementitious material into the top of the mold through the open portion to a level slightly above the pair of interior molding surfaces. The liquid cementitious material is allowed to harden and the hardened channel body with aligned reference surfaces is removed from the mold.

Therefore, the drainage channel of the present invention can be installed adjacent a number of different types of athletic playing surfaces, such as running track surfaces and artificial turf surfaces, while maintaining the upper surfaces of the grate and the playing surfaces level. More particularly, by providing a variety of edge adapters and grates, a single type or style of drainage channel of the present invention can installed adjacent a variety of athletic surfaces, thereby increasing the installation flexibility of this drainage system and limiting the fabrication costs associated with manufacturing the drainage channel sections.

The drainage channel of the present invention also effectively reduces trip hazards and allows athletes, spectators and vehicles to readily pass between adjacent playing surfaces and over the drainage channel. In addition, the drainage channel of the present invention which includes longitudinal elongate projections provides for the formation of subsurface layers to the proper elevation, thereby further insuring the eventual alignment of the overlying playing surfaces with the drainage channel. Further, the drainage channel and, more particularly, the longitudinal elongate projections extending outwardly therefrom serves as a mechanical fuse to protect the drainage channel from damage during the compaction of the subsurface layers.

BRIEF DESCRIPTION OF THE DRAWINGS

Some of the objects and advantages of the present invention having been stated, others will appear as the description proceeds, when taken in connection with the accompanying drawings, which are not necessarily drawn to scale.

FIG. 1 is an environmental sectional view of a drainage channel according to the present invention, illustrating a running track surface on one side and an artificial turf playing surface on the other side;

FIG. 2 is a sectional view of a drainage channel according to the present invention taken along lines 2—2 of FIG. 3;

FIG. 3 is a side elevational view of a drainage channel section according to the present invention and illustrating several strengthening ribs formed therein;

FIG. 4 is a bottom view of a drainage channel section according to an embodiment of the present invention;

FIGS. 5–13 illustrate the installation of a drainage channel according to the present invention wherein FIG. 5 is a perspective sectional view illustrating a preliminary grading step before the installation of the drainage channel;

FIG. 6 is a perspective sectional view illustrating the formation of a concrete pad for supporting the drainage channel;

FIG. 7 is a perspective sectional view illustrating the placement and alignment of a support brick on the concrete pad;

FIG. 8 is a perspective sectional view illustrating the placement of a drainage channel section on the support brick;

FIG. 9 is a perspective view illustrating both adjoining channel sections supported on the support brick;

FIG. 10 is a perspective sectional view illustrating the placement of encasement concrete adjacent to the drainage channel;

FIG. 11 is a perspective sectional view illustrating the application of a gravel layer;

FIG. 12 is a perspective sectional view illustrating the application of asphalt layers of different thicknesses on opposite sides of the drainage channel;

FIG. 13 is a perspective sectional view illustrating the application of a polymeric running track surface and an artificial turf surface;

DETAILED DESCRIPTION OF THE PREFERRED EMBODIMENTS

Figure 5:
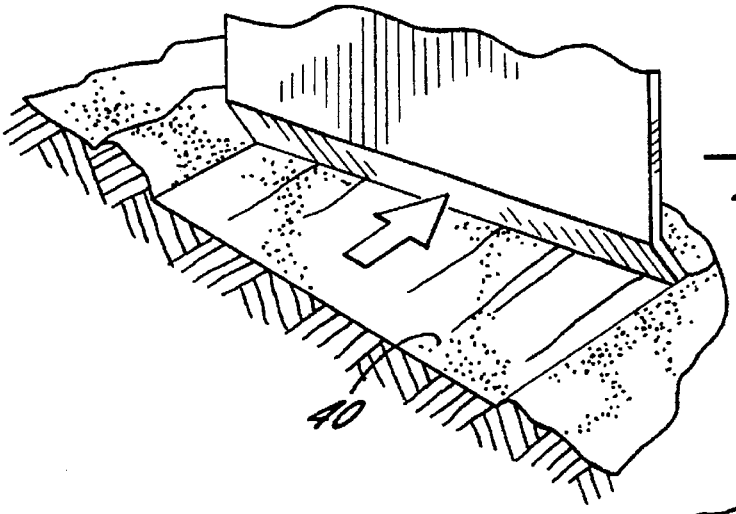

Various embodiments of the invention are set forth below. While the invention is described with reference to specific preferred devices and methods, including those illustrated in the drawings, it will be understood that the invention is not intended to be so limited. To the contrary, the invention includes numerous alternatives, modifications and equivalents as will become apparent from consideration of the present specification including the drawings, the foregoing discussion, and the following detailed description.

FIG. 1 illustrates a drainage channel 10 according to the present invention positioned along the interior edge of a running track 11. The drainage channel 10 may also be installed at other locations relative to the athletic playing surface in question, such as outside a running track surface or along the edges of other athletic playing fields. For example, an artificial turf playing surface 12 is illustrated on the opposite side of the drainage channel 10 of FIG. 1 and may be used for playing football or other field sports. In addition, the drainage channel 10 could border a natural turf field or an asphalt or paved surface.

A grate 13 is provided over the drainage channel 10 to prevent injury and to prevent relatively large objects, such as leaves and debris, from entering the channel and restricting the flow of liquid therethrough. As can be seen in FIG. 1, the grate 13 is arranged to provide a substantially planar and continuous transition surface between the running track 11 and the artificial turf 12 so that there are no protrusions which might trip athletes or interfere with the operation of various wheeled devices which may be used. Thus, the upper surface of the drainage channel 10, running track 11, and artificial turf playing surface 12 are all at substantially the same level.

The drainage channel 10 may include a plurality of longitudinally extending preformed or precast drainage channel sections 14 arranged in an end-to-end relationship. The channel sections 14 can be precast from various cementitious materials depending upon the type of fluids which the channel 10 is to collect and the type of loads the channel is expected to support. For example, precast drainage channel sections 14 are typically formed of polyester concrete, a concrete aggregate material containing coarse and inert mineral fillers bonded with polyester resin. As will be apparent, according to certain embodiments of the invention, the channel sections 14 can be formed from other cementitious and/or thermoformable or thermosetting polymers or formed from cast or formed metals such as stainless steel sheet. The channel sections 14 could also be formed of fiberglass.

A drainage channel section 14 and associated grate 13 are illustrated in more detail in the cross section of FIG. 2. The drainage channel section 14 includes a bottom wall 15 and a pair of sidewalls 16 extending upwardly from the opposed sides of the bottom wall so as to define an open top 17 for receiving the liquid runoff. As shown in FIG. 2, the bottom wall 15 is defined by an interior surface 20 and an exterior surface 21 and, in one embodiment, can be thicker than the sidewalls 16. Likewise, the sidewalls are typically each defined by an interior surface 22 and an exterior surface 23. In addition, the interior surface 20 of the bottom wall 15 may be substantially U-shaped or V-shaped so as to blend into the interior surfaces 22 of the sidewalls 16. The bottom wall 15 may have a uniform thickness along the length of the channel section 14 or, alternatively, the interior surface 20 of the bottom wall may be slightly sloped relative to the exterior surface 21 to enhance liquid flow along the channel 10.

The exterior surface 21 of the bottom wall 15 may be generally flat for stably supporting the drainage channel section 14, as discussed in more detail below. In addition, the exterior surface 21 of the bottom wall 15 may be extended outwardly when viewed in cross section so as to define a pedestal-type shape and to enhance the lateral stability of the drainage channel section 14. However, the bottom wall can be formed in other configurations without departing from the spirit and scope of the present invention.

The grate 13 may be secured to the channel 10 by way of a locking block 24 carried in a recess in the sidewalls 16 in the manner disclosed in U.S. Pat. No. Re. 33,439 to Thomann et al. and assigned to the assignee of the present invention, which is incorporated herein by reference. As disclosed therein, a locking strap 25 is carried transversely by a bolt 26 rotatably mounted in the grate 13. The locking block 24 has an oblique wall therein which allows rotation of the locking strap 25 in the direction of tightening of the bolt 26. The locking strap is prevented, however, from rotating past a vertical wall 27 of the locking block 24. Further tightening of the bolt 26 draws the locking strap 25 against an upper horizontal wall 28 of the locking block 24 and the grate 13 becomes securely fastened.

As shown in FIGS. 3 and 4, the drainage channel 10 may further include three or more vertical strengthening ribs 30 along the exterior surface 23 of the sidewalls 16 to strengthen the drainage channel 10. These ribs 30 are adapted to support heavy compressive loads which may occur, for example, when vehicles are driven over the drainage channel 10. In addition, significant transverse loads on the sidewalls 16 may be caused by thermal expansion or contraction of the adjacent surface or subsurface layers. In particular, artificial turf, which may be held between the grate 13 and sidewalls 16 of the channel in the manner discussed below, can contract when the ambient temperature is low and cause substantial outwardly directed loading of the sidewalls which is, at least partially, supported by ribs 30.

The sidewalls 16 may also each include an upper surface 31 for supporting the grate 13. In a preferred embodiment, the upper surface 31 is generally horizontal and defines a longitudinal slot 32 therein for receiving an edge adapter 33 to define an edge of the athletic surface as discussed further below.

Figure 14:
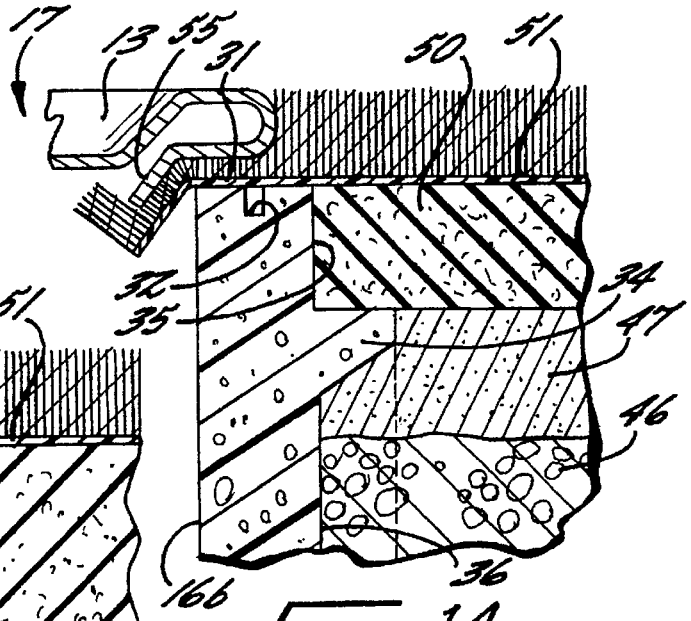
FIG. 14 is an enlarged sectional view of a projection on the channel illustrating the level of the subsurface layers relative thereto.
Figure 15:
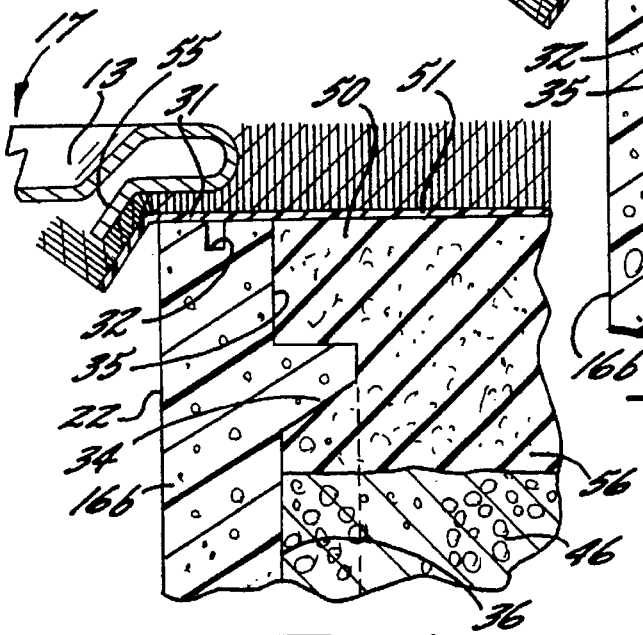
FIG. 15 is an enlarged sectional view of the same area as FIG. 14 but illustrating an alternative subsurface layer.

As shown in FIG. 2, and in more detail in FIGS. 14 and 15, the drainage channel of the present invention preferably includes at least one and, more preferably, a pair of longitudinally elongate projections 34 which extend transversely outwardly from the exterior surfaces 23 of the sidewalls 16. The projections preferably extend from at least a medial portion of the lengthwise extending sidewalls and, more preferably, from substantially the entire length of the sidewalls. Typically, the projections are located closer to the top of the drainage channel than the bottom and, in one advantageous embodiment, the projections 34 are spaced at a predetermined distance below the open top 17, such as between about ¼ inch and about one inch and, more particularly, about ⅝ths of an inch. As shown, the projections also extend outwardly beyond at least a section 35 of the sidewall 16 above the projection and a section 36 of the sidewall below the projection. At least portions of each section of the sidewall above 35 and below 36 the projection 34 are generally coplanar with each other. In addition, since the projections are generally located relatively near the open top of the drainage channel, the section of the sidewall below the projection is typically larger than the section of the sidewall above the projection.

As discussed in more detail below, these projections 34 are particularly advantageous for defining the level, such as the horizontal level, to which one or more of the subsurface layers should be formed and, accordingly, are preferably formed relative near to and at a predetermined distance from the open top of the drainage channel. In addition, the projections 34, which may be cast in place with the channel body 14 or preformed from the same or other material and then affixed to the channel body, are relatively thin, such as 4 mm, and can act as mechanical fuses which shear away from the sidewall 16 in response to excessive loading without damaging the sidewall.

Although a projection 34 is illustrated on each of the sidewalls 16 and at the same elevation as the opposing projection, it will be understood that the channel 10 may include only one projection, multiple projections on one or both of the sidewalls 16, and/or a projection on one sidewall at an elevation different than a projection on the opposite sidewall. In addition, while shown to extend outwardly in a longitudinally continuous manner, the projections could also include a number of tabs which extend outwardly at spaced intervals along the sidewalls to thereby define the level to which a subsurface layer should be formed and to serve as a mechanical fuse as described above.

The present invention also includes an associated method of installing the drainage channel as illustrated sequentially in FIGS. 5–13. As shown in FIG. 5, a base surface 40 is first formed by appropriate grading with earth-moving equipment. The entire area below the desired athletic playing surface may be graded to a common base level, as shown, so that the subsurface layers can be formed evenly thereon. Alternatively, a trench of the desired depth may be formed to accommodate the drainage channel 10.

Figure 6:
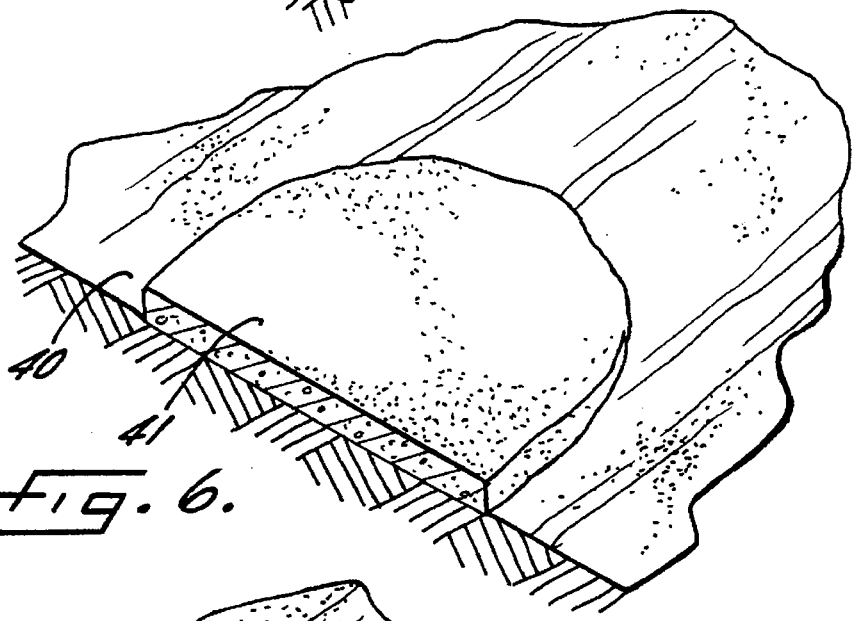

A plurality of pads 41 of concrete or other supportive material are then formed on the graded base surface 40, as illustrated in FIG. 6. The pads 41 are spaced at discrete intervals corresponding to the length of the drainage channel sections 14, which is typically about one meter. Although individual pads 41 are shown, it will be understood that a continuous strip of concrete could also be deposited so as to form a footer.

Figure 7:
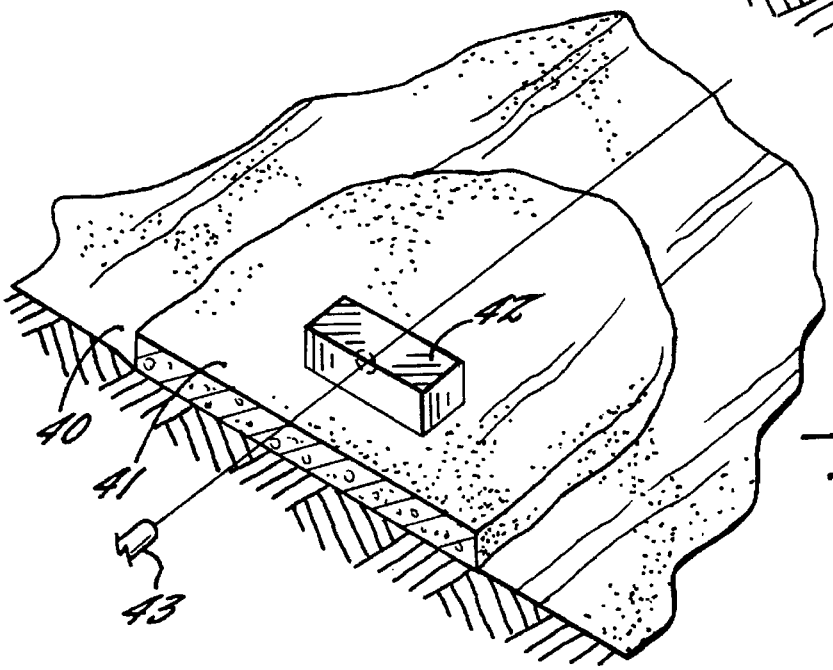

While the concrete pads 41 are still wet, a support 42 for the drainage channel sections 14, such as a cement a cement brick, is placed on each pad, as illustrated in FIG. 7. The support bricks 42 are typically placed in the orientation shown with the broadest side facing upwards. Each of the support bricks 42 is then aligned with the other bricks, such as with the illustrated laser alignment device 43 or, more conventionally, with a string extending across the upper surface of the support bricks, by making minor adjustments to the bricks in the wet concrete.

All of the bricks 42 may be aligned to lie in the same horizontal plane as in the case when the interior surface 20 of the bottom wall 15 of the drainage channel 10 is slightly sloped as discussed above. If the interior surface 20 is not sloped, the support bricks 42 may also be aligned in a horizontal plane or, alternatively, each of the support bricks may be offset slightly lower or higher than an adjacent support brick so as to provide a slight slope to the drainage channel 10.

Figure 8:
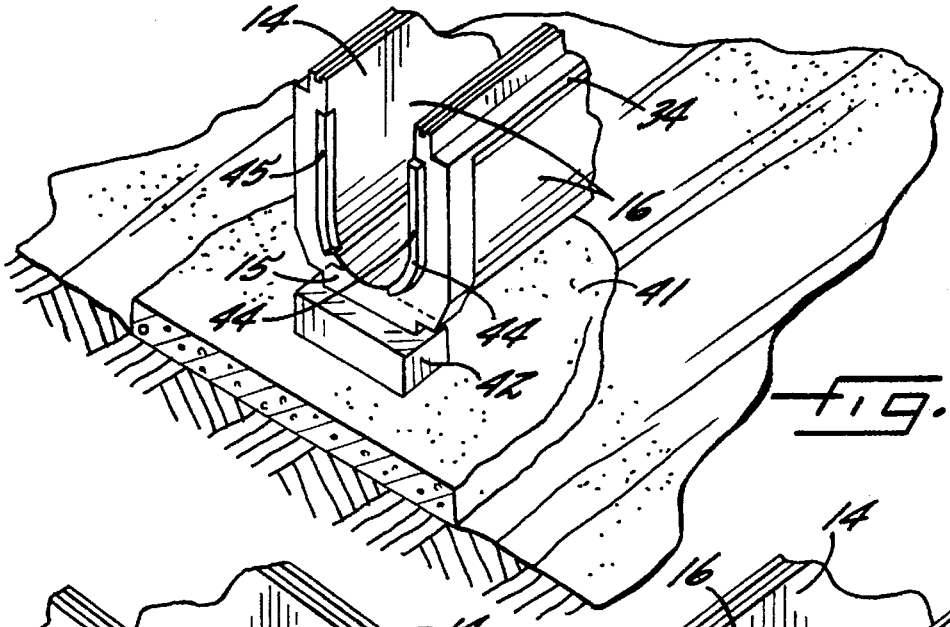

Once the supports are aligned, a drainage channel section 14 is placed on two adjacent support bricks 42 with the drainage channel section overlying only approximately half of each of the support bricks, as shown in FIG. 8. Thus, adjoining drainage channel sections 14 can be placed on the same support bricks 42 in an aligned relationship with the adjacent channel section.

Figure 8A:
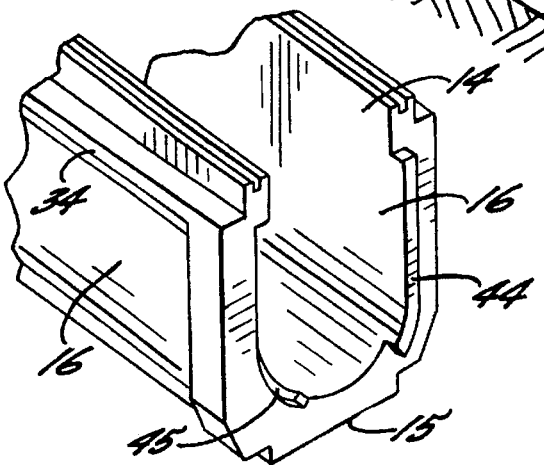
FIG. 8A to 8B are perspective views illustrating the corresponding male-female structure of the adjacent ends of two adjoining channel sections.
Figure 8B:
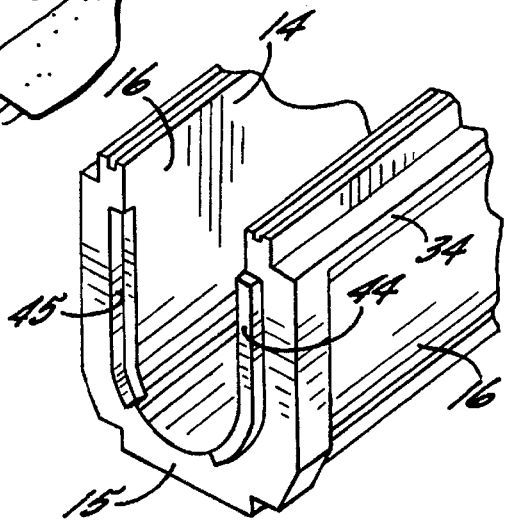
Figure 9:
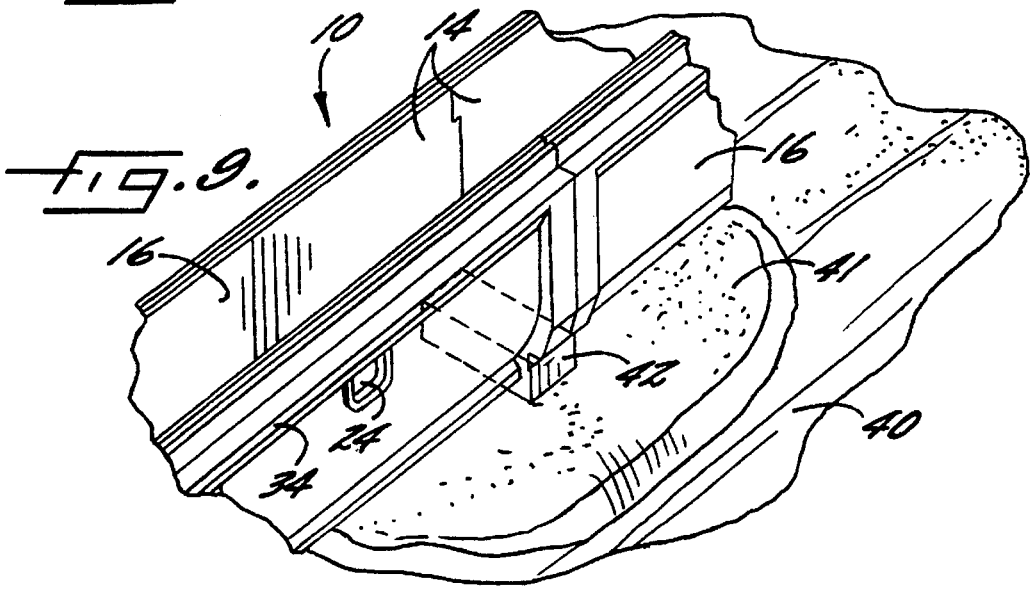

Each of the drainage channel section ends may be provided with a male projection 44 and a corresponding female recess 45, as illustrated in FIGS. 8A and 8B and also in FIG. 4. The projection 44 and recess 45 extend vertically along the end surfaces of the sidewalls 16 of the drainage channel section and may extend partly into the bottom wall 15. Accordingly, both ends of the drainage channel sections 14 include both male and female interlocking parts so that either end of a given drainage channel section may be placed adjacent to and interlock with either end of an adjoining drainage channel section on a support brick 42, as illustrated in FIG. 9. For a drainage channel which is non-sloping, this configuration is an improvement over drainage channel sections having one female-only end and one male-only end because it is not necessary to orient all of the drainage channel sections with the male or female ends facing in the same direction. A sealant or adhesive can also be applied to the adjacent ends of the adjoining drainage channel sections to prevent leakage of the channel 10.

Figure 10:
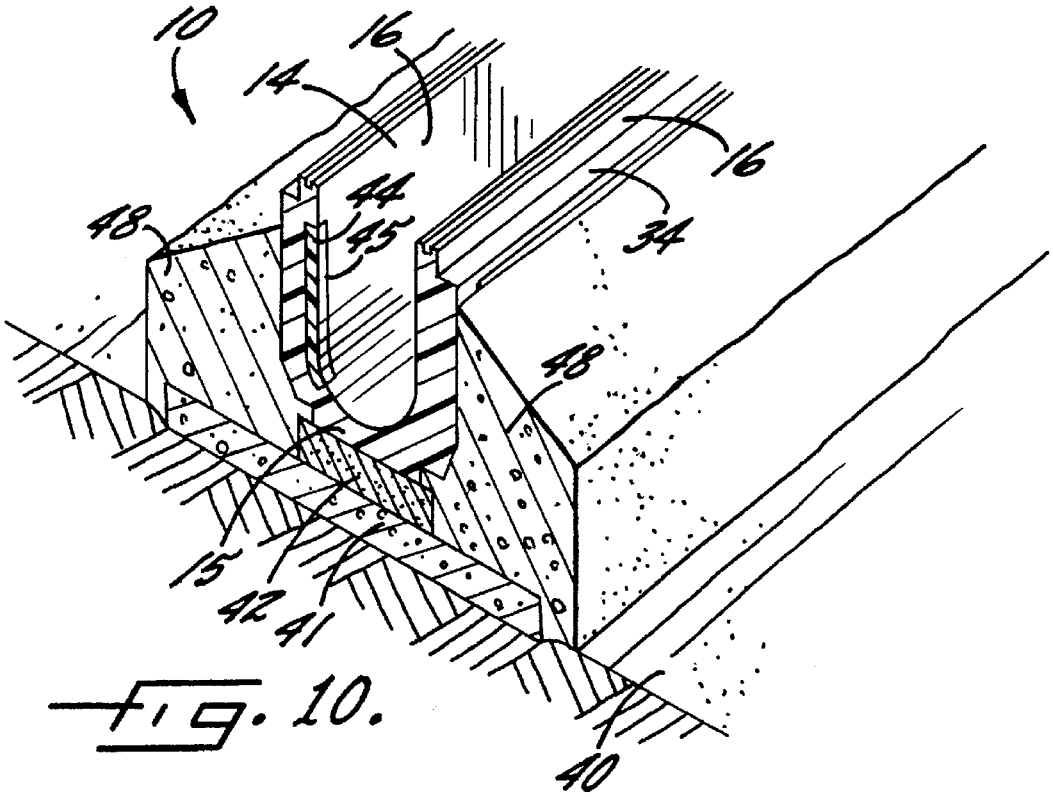
Figure 11:
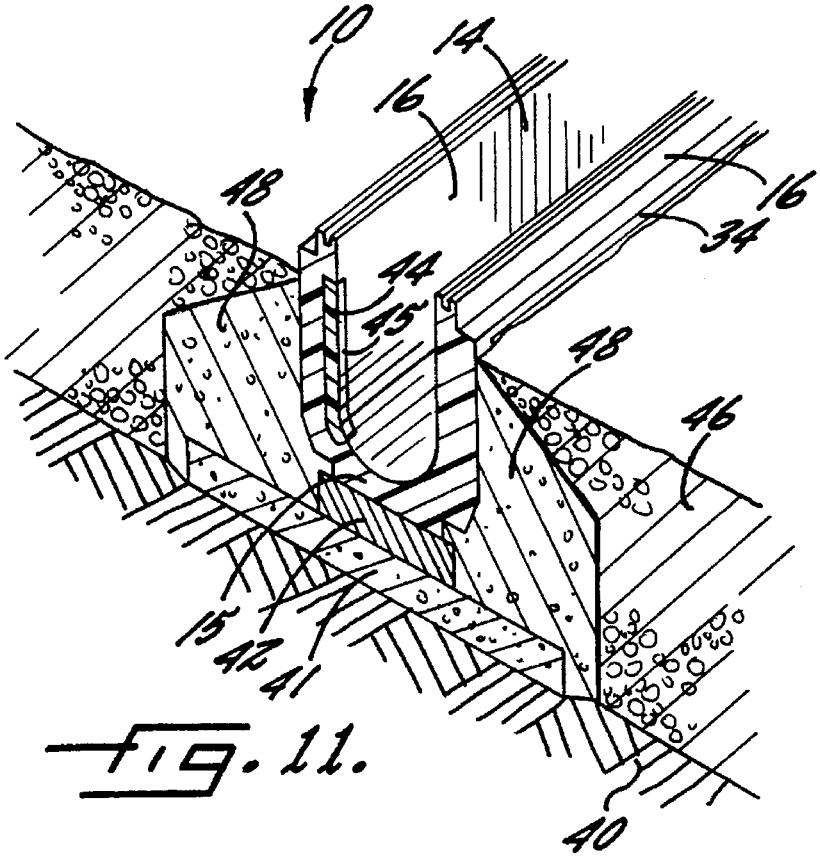

In order to secure the drainage channel sections in position, encasement concrete 48 can then be poured against the sidewalls of the drainage channel, as illustrated in FIG. 10. While the amount and shape of the encasement concrete 48 can be varied without departing from the spirit and scope of the present invention, the encasement concrete at the base of the channel 10 is preferably sufficient, however, to fully support the drainage channel and to prevent adjoining sections from shifting relative to one another. As illustrated in FIG. 11, a compacted layer of gravel, rock or sand 46 may then be applied to a level substantially equal to or slightly higher than the uppermost point of the encasement concrete 48 and may extend across the entire area below the desired athletic playing surface.

Figure 12:
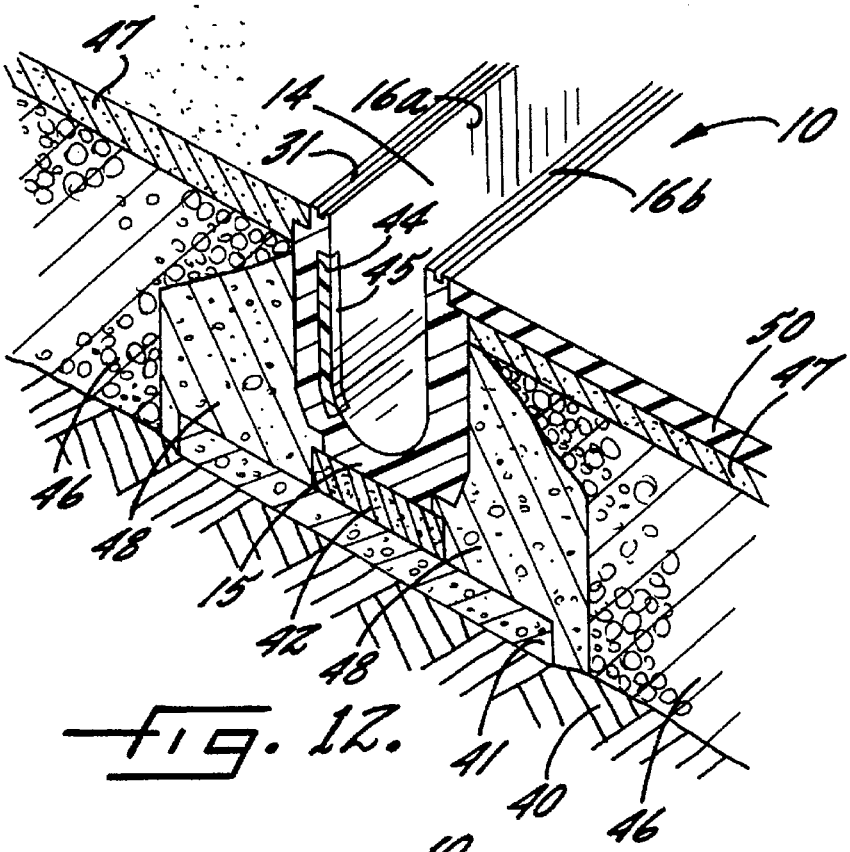

In one embodiment of the invention, an asphalt layer 47, comprised of either porous or nonporous asphalt, is then formed over the gravel layer 46, as shown in FIG. 12. The height or elevation to which the asphalt layer 47 is formed depends in part on the type of playing surface that is desired. For example, for running track surfaces as shown on the left-hand side of the drainage channel 10 of FIG. 12, the asphalt layer 47 is formed to a height substantially even or level with the horizontal upper surface 31 of the adjacent sidewall **16*a***.

For artificial turf surfaces, as shown on the right-hand side of the drainage channel of FIG. 12, however, the asphalt layer 47 is formed, instead, to a height or elevation corresponding to that of the outwardly extending projection 34 on the corresponding sidewall **16*b*. In one advantageous embodiment, this projection 34 is spaced at a predetermined distance below the open top 17 of the drainage channel which corresponds to the thickness of a foam layer 50, such as ⅝ inch, which will be placed on the asphalt layer for supporting the artificial turf 51. The longitudinally extending projection is thus advantageous as a visual reference point or as an installation guide for installers when forming the asphalt layer 47** so as to further ensure that the uppermost surface of the athletic playing surface will be at the desired elevation. Accordingly, the projection preferably extends from at least a medial portion of the respective sidewall and, more preferably, from substantially the entire length of the respective sidewall such that the projection can be readily employed as an installation guide.

Before application of the final surface layers, it may be necessary to mechanically compress or compact the subsurface layers adjacent to the drainage channel 10 to ensure proper packing. Vibratory tamping or rolling machinery may be used which, if improperly applied, could damage the structure of the channel 10 and require expensive replacement. In particular, the compaction machinery could break portions of the bottom wall 15 and/or the sidewalls 16 of the drainage channel 10 so as to cause it to leak or even collapse. With the present invention, however, if the compressive force applied is too large and/or too close to the sidewall 16, the projection 34 will act as a mechanical fuse and shear away from the sidewall. This shearing will relieve the applied compressive load without fracturing the sidewalls 16 and will signal the machinery operator to move away from the channel 10 before the channel is structurally destroyed.

Figure 13:
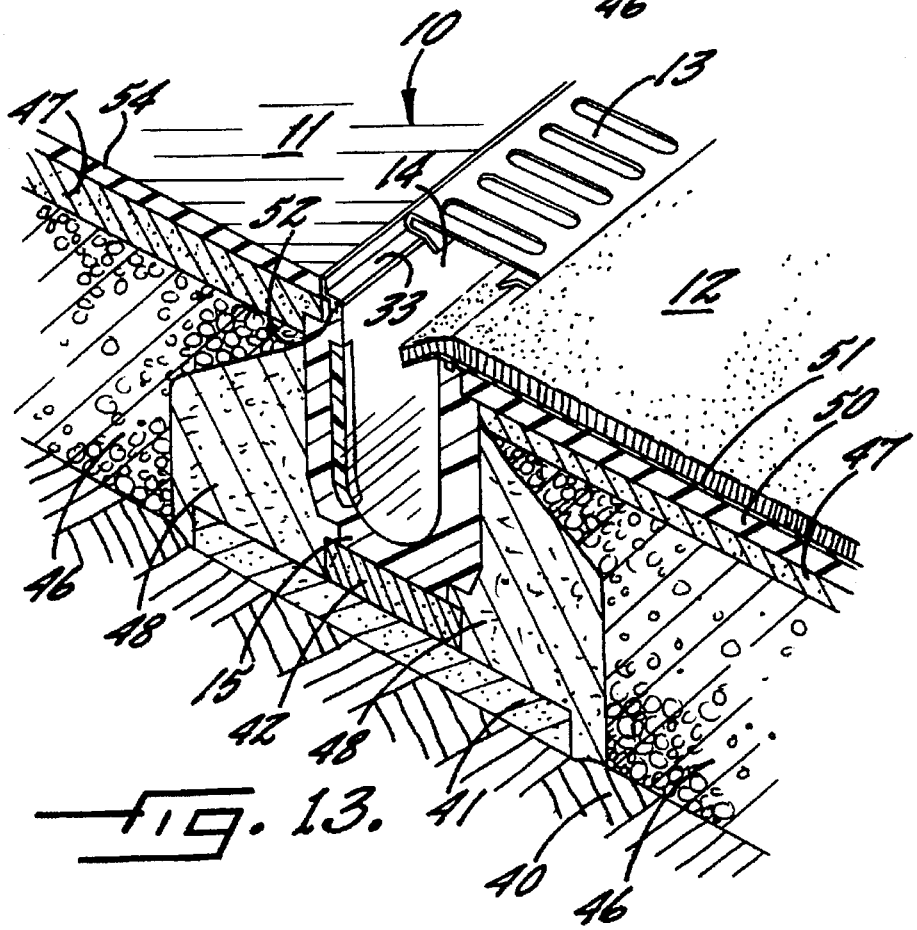

For polymeric running track surfaces, a generally "L"-shaped edge adapter 33 may then be secured to the horizontal upper surface 31 of the sidewall 16 of the drainage channel 10, as shown in FIG. 13. The edge adapter 33 is formed of a generally continuous strip of resilient material, preferably a plastic and, more preferably a plasticized polyvinylchloride or vinyl rubber having a hardness of less than about 90 durometer, and may include a downwardly facing plug 52 for engagement within the slot 32 in the horizontal upper surface 31 of the sidewall 16. Alternatively, the edge adapter 33 may be glued, snapped over, or secured by other means to the sidewall.

The "L"-shaped edge adapter shown in FIG. 13 as well as several other configurations of the edge adapter are described in detail in U.S. patent application Ser. No. 08/568,254 to Charles E. Gunter entitled "Edge Adapter for Athletic Playing Surface and Associated Method" filed concurrently herewith and assigned to the assignee of the present invention, the contents of which are incorporated by reference herein.

A polymeric running surface 54, which is applied as a moldable material, principally in liquid form, is then poured over the asphalt layer 41 to a level typically corresponding to the upper edge of the edge adapter 33. The edge adapter 33 thus serves as a dam to restrain the liquid polymer 54 before it cures or hardens. In addition, the edge adapter serves as an installation guide for gauging the desired elevation of the running surface. After hardening, the running track 11 thus has a well-defined edge which is supported by the edge adapter 33, but which does not have any upward protrusions which could cause injury.

For artificial turf surfaces, such as shown on the right-hand side of the drainage channel 10 in FIGS. 13 and 14, a foam layer 50 is applied over the asphalt layer 47 which has a thickness which places its upper surface at a level generally corresponding to the horizontal upper surface 31 of the right-hand sidewall **16*b*. The artificial turf 51 is then laid over the foam layer 50**.

As shown in more detail in FIG. 14, the edge of the artificial turf 51 may extend over the sidewall 16 and into the interior of the channel 10 so that it is trapped between the grate 13 and channel when the grate is fastened to the drainage channel. As shown, the grate 13 of the advantageous embodiment may include an inwardly and downwardly extending surface 55, which may also include barbs or serrations (not shown), to firmly grip the edge of the artificial turf 51 and to pull it tighter as the grate 13 is tightened down in the manner discussed above. The grate shown in FIGS. 13–15 as well as several other configurations of the grate are described in detail in U.S. patent application Ser. No. 08/568,301 to Charles E. Gunter entitled "Drainage Channel Grates For Athletic Playing Surfaces And Associated Methods" filed concurrently herewith and assigned to the assignee of the present invention, the contents of which are incorporated by reference herein.

As can be best seen in FIGS. 13–15, the artificial turf layer 51 includes a backing layer and a plurality of stiff but pliable artificial fibers secured to the backing layer. The artificial turf layer thus has a predetermined thickness which may be reduced to a predetermined crush height by the bending and folding over of the artificial fibers when subjected to a compressive load.

In one advantageous embodiment, the crush height of the artificial turf 51 between the upper surface of the sidewall 16 and the grate 13 may be approximately equal to the thickness of the horizontally extending base portion of the L-shaped edge adapter 33 so that the grate is maintained in a substantially horizontal orientation over the drainage channel. In addition to drainage, the channel 10 and grate 13 thus also serve as a fixed anchor for the edge of the artificial turf 51. Accordingly, in some athletic facilities, the drainage channel 10 may not provide drainage, but will serve to anchor the artificial turf and/or provide an edge to the polymer athletic surface.

An alternative construction for the artificial turf surface than that shown in FIGS. 12–14 is illustrated in FIG. 15. Specifically, the asphalt 47 and foam layers 50 are replaced with one elastic or "E-layer"56 of the same thickness as the combined thicknesses of the asphalt 47 and foam 50 layers. The "E-layer"56 is resilient and serves a cushioning function to help prevent injury to athletes. The "E-layer"56 is typically formed of a plurality of discrete individual rubber particles held together in a binder. As shown in FIG. 15, the projection 34 also serves an anchoring function to prevent vertical displacement of a subsurface layer, such as the "E-layer", relative to the sidewall 16 of the drainage channel 10, which displacement could cause that subsurface layer to become loose.

In each of the above embodiments, however, the surface layers formed on the opposite sides of the drainage channel 10 are preferably level and aligned. In addition, the upper surface of the drainage channel, such as the upper surface of the grate 13, is also preferably level and aligned with the adjacent playing surfaces. Accordingly, the drainage channel of the present invention effectively reduces, if not eliminates, trip hazards and allows athletes, spectators and vehicles to readily pass thereover.

Figure 16:
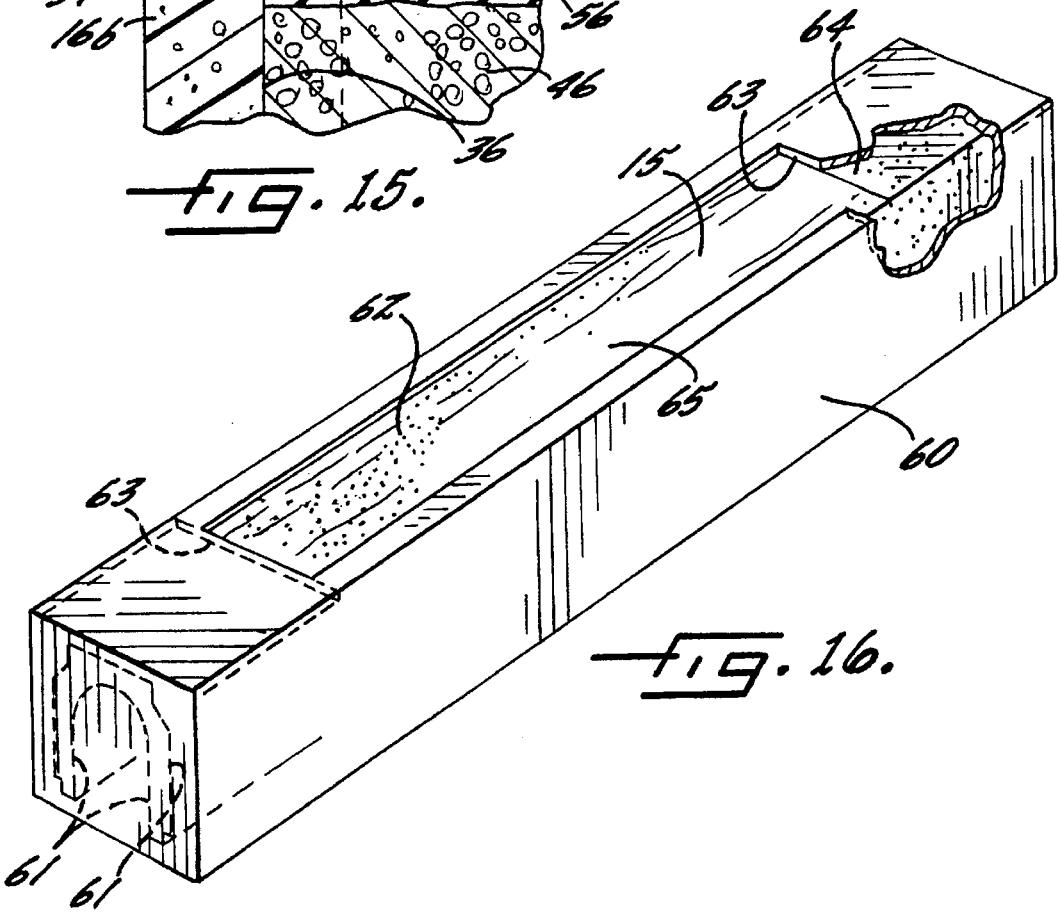
FIG. 16 is a perspective and cut away view illustrating a mold used to form a drainage channel section according to an embodiment of the present invention.

The drainage channel 10 according to the present invention may be formed in several ways from several different types of materials, as discussed above. In a preferred embodiment, the drainage channel sections 14 are formed by molding or casting a liquid cementitious material, such as polymeric concrete. A preferred mold 60 for forming a drainage channel section 14 according to the present invention is illustrated in FIG. 16.

The mold 60 includes various interior surfaces 61 which are shaped for forming the interior 22 and exterior 23 surfaces of the sidewalls 16, the interior surface 20 of the bottom wall 15 and the opposed exterior surfaces of the ends of the channel section 14. The top of the mold 60, which corresponds to the bottom wall 15 of a drainage channel section 14, is generally at least partially open so that a liquid cementitious material 62 may be poured into the mold. After the liquid material 62 has dried and hardened, the channel section 14 can be removed from the mold 60.

In a preferred embodiment of the invention, the mold 60 includes downwardly facing interior molding surfaces 63 at each end thereof to form a shaped reference surface 64 on each end of the exterior surface 21 of the bottom wall 15 of the channel section 14. Thus, when forming the channel section 14, the liquid material 62 can be poured into the mold 60 to a level slightly higher than the interior molding surfaces 63 of the mold. Vibration may then be applied to the interior molding surfaces 63 to remove any air bubbles previously trapped under the interior molding surfaces.

After hardening, the surface of a medial portion 65 of the bottom wall 15 between the opposed reference surfaces 64 may be rough, unshaped and unfinished and may include solidified air bubbles which could not escape from the material 62 prior to its hardening. Because of the interior molding surfaces 63, however, the reference surfaces 64 will be substantially planar and considerably smoother than the medial portion 65.

The shaped reference surfaces 64 are located in a predetermined positional relationship and, more preferably, are coplanar with each other. In addition, the shaped reference surfaces are preferably formed at a predetermined distance below the open top 17 of the channel section 14. The shaped reference surfaces 64 thus ensure that adjoining drainage channel sections 14 supported on a common support brick 42 will be maintained in a corresponding predetermined positional relationship. Typically, the shaped reference surfaces are coplanar to ensure that adjoining drainage channel sections will be vertically aligned at their open tops 17 and that the horizontal projections 34 of both of the adjoining sections will be aligned.

Although a completely flat shaped reference surface 64 has been illustrated and described, it will be understood that the shaped surfaces of the channel section 14 and corresponding surfaces 63 of the mold need not be completely flat and continuous, but only that the surfaces have one or more planar reference surfaces. For example, the ends may have a castellated configuration which would be equally as suitable for obtaining the advantages of the configuration illustrated. In addition, although a shaped reference surface 64 formed by molding or casting is shown and described, it will be understood that the surface may be shaped by other means, such as by subsequent milling or by using a preshaped mold insert made of a material which may be different than that of the channel body.

Therefore, the drainage channel 10 of the present invention can be installed adjacent a number of different types of athletic playing surfaces, such as running track surfaces and artificial turf surfaces, while maintaining the upper surfaces of the grate 13 and the playing surfaces level. More particularly, by providing a variety of edge adapters 33 and grates 13, a single type or style of drainage channel 10 of the present invention can installed adjacent a variety of athletic surfaces, thereby increasing the installation flexibility of this drainage system and limiting the fabrication costs associated with manufacturing the drainage channel sections.

The drainage channel 10 of the present invention also effectively reduces trip hazards and allows athletes, spectators and vehicles to readily pass between adjacent playing surfaces and over the drainage channel 10. In addition, the drainage channel 10 of the present invention which includes longitudinal elongate projections 34 provides for the formation of subsurface layers to the proper elevation, thereby further insuring the eventual alignment of the overlying playing surfaces with the drainage channel 10. Further, the drainage channel 10 and, more particularly, the longitudinal elongate projections 34 extending outwardly therefrom serves as a mechanical fuse to protect the drainage channel 10 from damage during the compaction of the subsurface layers.

The invention has been described in considerable detail with reference to preferred embodiments. However, many changes, variations, and modifications can be made without departing from the spirit and scope of the invention as described in the foregoing specification and defined in the appended claims. For example, while the drainage channels 10, edge adapters 33 and grates 13 are described in conjunction with athletic playing surfaces, these drainage system components can border and provide drainage for other surfaces without departing from the spirit and scope of the present invention.

That which is claimed is:

1. An elongate drainage channel capable of receiving runoff from an athletic surface, said channel comprising:

a bottom wall;

a pair of sidewalls extending upwardly from opposed sides of said bottom wall and defining an open top for receiving the runoff, each of said sidewalls comprising an exterior surface; and a longitudinally elongate projection extending transversely outwardly from said exterior surface of at least one of said sidewalls along a substantial longitudinal portion thereof and being spaced at a predetermined distance below said open top to thereby divide the sidewall into upper and lower sections, said projection extending outwardly beyond at least a portion of both said upper and lower sections of said sidewall, at least portions of both said upper and lower sections of said sidewall adjacent said longitudinally extending projection being generally coplanar with each other such that said projection is preferentially fracturable from said exterior surface of said sidewall in response to a downward loading force thereon.

2. A drainage channel as defined in claim 1 wherein said projection has a predetermined thickness and wherein said sidewall has a predetermined thickness more than that of said projection such that said projection is fracturable from said exterior surface in response to a downward loading force thereon.

3. A drainage channel as defined in claim 2 wherein said projection has a thickness of less than about 4 mm.

4. A drainage channel as defined in claim 1, wherein said predetermined distance is between about ½ inches and ¾ inches.

5. A drainage channel as defined in claim 4, wherein said predetermined distance is about ⅝ inches.

6. A drainage channel as defined in claim 1, wherein at least one of said sidewalls defining said open top further comprises a substantially horizontal upper surface which defines a longitudinally extending slot therein for receiving a grate.

7. A drainage channel as defined in claim 1 further comprising first and second opposed end surfaces defined by said bottom wall and said sidewalls, said opposed end surfaces comprising:

a male projection in said first end surface adjacent one of said sidewalls;

a corresponding female recess in said second end surface adjacent said one sidewall;

a female recess in said first end surface adjacent the other of said sidewalls; and a corresponding male projection in said second end surface adjacent said other sidewall.

8. A drainage channel as defined in claim 1 wherein said sidewalls further comprise a plurality of vertically extending strengthening ribs formed in said vertical exterior of said sidewalls.

9. A drainage channel as defined in claim 1 wherein said channel is formed of a molded cementitious material.

10. An elongate drainage channel capable of receiving runoff from an athletic surface, said channel comprising:

a bottom wall;

a pair of sidewalls extending upwardly from opposed sides of said bottom wall and defining an open top for receiving the runoff, each of said sidewalls comprising an exterior surface; and a longitudinally elongate projection extending transversely outwardly from said exterior surface of at least one of said sidewalls along at least a medial portion of the lengthwise extending sidewall, said longitudinally elongate projection being spaced at a predetermined distance below said open top to thereby divide the sidewall into upper and lower sections, wherein said projection extends outwardly beyond at least a portion of both said upper and lower sections of said sidewall, and wherein the lower section is larger than the upper section and at least portions of both said upper and lower sections of said sidewall adjacent said longitudinally extending projection being generally coplanar with each other such that said projection is preferentially fracturable from said exterior surface of said sidewall in response to a downward loading force thereon.

11. A drainage channel as defined in claim 10 wherein said projection has a predetermined thickness and wherein said sidewall has a predetermined thickness more than that of said projection such that said projection is fracturable from said exterior surface in response to a downward loading force thereon.

12. A drainage channel as defined in claim 11 wherein said projection has a thickness of less than about 4 mm.

13. A drainage channel as defined in claim 10, wherein said predetermined distance is between about ½ inches and ¾ inches.

14. A drainage channel as defined in claim 13, wherein said predetermined distance is about ⅝ inches.

15. A drainable athletic field for supporting an athletic surface comprising:

a base surface;

an elongate drainage channel capable of receiving runoff from said athletic surface, said channel comprising:

a bottom wall having an outer surface for supporting said channel on said base surface;

a pair of sidewalls extending upwardly from opposed sides of said bottom wall and defining an open top for receiving the runoff, each of said sidewalls comprising an exterior surface; and a projection extending outwardly from said exterior surface of at least one of said sidewalls at a predetermined distance below said open top to thereby provide an installation guide during fabrication of the drainable athletic field, said projection extending longitudinally along at least a portion of said channel; and a subsurface layer deposited on said base surface and against at least said one sidewall up to a height defined by said projection such that said subsurface layer is spaced below the open top of said drainage channel by the predetermined distance; and an athletic surface layer overlying said subsurface layer for directing runoff over said one sidewall and into said open top of said channel.

16. A drainable athletic field as defined in claim 15 wherein at least one of said sidewalls defining said open top of said channel further comprises a substantially horizontal upper surface and a longitudinally extending slot formed therein for supporting a grate.

17. A drainable athletic field as defined in claim 15 wherein said channel is formed of a molded cementitious material.

18. A drainable athletic field as defined in claim 17 wherein said projection has a predetermined thickness and wherein said sidewall has a predetermined thickness more than that of said projection such that said projection is fracturable from said exterior surface in response to a downward loading force thereon.

19. A drainable athletic field as defined in claim 15 wherein said drainage channel further comprises a plurality of adjoining drainage channel sections positioned in an end-to-end relationship.

20. A drainable athletic field as defined in claim 15 wherein said base surface is generally horizontal and wherein said bottom wall of said drainage channel is sloped relative to said generally horizontal base surface.

21. An elongate channel section for use in preparing an elongate channel capable of receiving runoff from an athletic surface, said channel section comprising:

a pair of sidewalls defining an open top for receiving the runoff; and a bottom wall extending between said pair of sidewalls and including an exterior bottom surface having opposed end portions adjacent opposed ends of said channel section;

each of said end portions of said bottom surface being precision shaped as a generally planar reference surface, said precision shaped reference surfaces being coplanar and spaced at a predetermined distance below said open top for supporting said opposed ends of said channel section in a predetermined relationship such that the precision shaded reference surfaces can support the open top of the drainage channel section in a vertically aligned relationship with the open top of an adjoining drainage channel section.

22. An elongate channel section as defined in claim 21 wherein said exterior bottom surface further comprises a medial portion between said end portions, said medial portion being an unshaped surface independent of the coplanar end portions of said exterior bottom surface.

23. An elongate channel section as defined in claim 21 wherein said channel is formed of a molded cementitious material.

24. A molded drainage channel section for use in preparing a drainage channel, said channel section comprising:

a bottom wall having an exterior bottom surface with opposed end portions adjacent opposed ends of said channel section;

each of said end portions of said bottom surface being precision molded as a generally planar reference surface, said precision molded reference surfaces being coplanar with each other for supporting said opposed ends of said channel section in a predetermined relationship;

a pair of sidewalls extending upwardly from the opposed sides of said bottom wall and defining an open top, each of said sidewalls comprising an exterior surface; and a longitudinally elongate projection extending transversely outwardly from said exterior surface of at least one of said sidewalls along at least a longitudinal portion thereof, said projection extending outwardly beyond at least a portion of said sidewall above said projection and beyond at least a portion of said sidewall below said projection, said protection also being spaced at a predetermined distance above said precision molded reference surfaces such that said projection can be aligned with a longitudinally elongate protection of an adjoining drainage channel section.

25. An elongate drainage channel capable of receiving runoff from an athletic surface comprising:

a series of adjoining drainage channel sections each having opposed ends positioned adjacent to the respective ends of said adjoining channel sections;

a plurality of supports for supporting said drainage channel sections, each of said supports having a substantially planar surface underlying each of the respective adjacent ends of two adjoining channel sections;

each of said channel sections having a pair of sidewalls defining an open top for receiving the runoff; and a bottom wall extending between said pair of sidewalls and including an exterior bottom surface with opposed end portions adjacent said opposed ends of said channel section;

each of said end portions of said bottom surface being precision shaped as a generally planar reference surface, said precision shaped reference surfaces being coplanar and spaced at a predetermined distance below said open top for supporting said opposed ends of said channel section on said planar surface of said supports, wherein the respective precision shaded reference surfaces of said channel sections are located in a predetermined positional relationship such that the adjoining channel sections supported by said supports are maintained in a corresponding predetermined positional relationship to thereby vertically align the respective open tops of the adjoining channel sections.

26. An elongate drainage channel as defined in claim 25 wherein each of said opposed ends of each of said drainage channel sections comprises a male projection and a female recess in cooperative registration with a respective female recess and male projection in an adjacent end of an adjoining channel section.

27. An elongate drainage channel as defined in claim 25 wherein each of said supports comprises a brick.

28. An elongate drainage channel as defined in claim 25 further comprising sealant disposed between and around said adjacent ends of adjoining channel sections to prevent leakage.

* * * * *